United States Patent [19]

Saxton et al.

[11] 4,211,605

[45] Jul. 8, 1980

[54] HIGH YIELD CHEMIMECHANICAL PULPING PROCESSES

[75] Inventors: William R. Saxton, l'Orignal; William H. Lawford, Hawkesbury, both of Canada

[73] Assignee: Canadian International Paper Company, Quebec, Canada

[21] Appl. No.: 930,793

[22] Filed: Aug. 3, 1978

[51] Int. Cl.[2] ..... D21C 3/06; D21C 3/12

[52] U.S. Cl. ..... 162/64; 162/84

[58] Field of Search ..... 162/83, 84, 25, 28, 162/64

[56] References Cited

U.S. PATENT DOCUMENTS

| | | | |
|---|---|---|---|
| 1,722,993 | 8/1929 | Bradley | 162/84 |
| 2,921,879 | 1/1960 | Sohn | 162/84 |
| 3,393,122 | 7/1968 | Marshall et al. | 162/84 |
| 4,116,758 | 9/1978 | Ford et al. | 162/83 |

FOREIGN PATENT DOCUMENTS

| | | | |
|---|---|---|---|
| 589564 | 12/1959 | Canada | 162/83 |
| 1517169 | 8/1970 | Fed. Rep. of Germany | 162/83 |

OTHER PUBLICATIONS

Brown, "High-Yield Semichemical Pulps from Aspen and Balsam Fir for Printing Paper Production," Forest Services, Forest Laboratories, Project No. 50-7-298, in Cooperation with Univ. of Wisconsin, 6-1958.

Kleinert et al., "Thermal Coalescence of the Lignin Phase in Wood," Tappi, vol. 47, No. 10, Oct. 1964.

*Primary Examiner*—S. Leon Bashore
*Assistant Examiner*—Steve Alvo

[57] ABSTRACT

An improved, three-stage process for producing high yield chemimechanical pulps from wood or other lignocellulosic materials, such as chips, whereby, in the first stage, the wood or other lignocellulosic material is treated with sulfur dioxide gas or aqueous solution of sulfur dioxide, whereby sufficient sulfur dioxide is present to provide an amount of at least about 1 percent by weight based on weight of wood or other lignocellulosic material; in the second stage, said wood is sulfonated in an aqueous solution of sodium sulfite at a temperature of between about 100° C. and 150° C. for between about 10 and 90 minutes, said aqueous solution having a pH of between about 6 and 8.5 at the end of said sulfonating, without reducing the pulp yield to below about 90 percent; and, in the third stage, subjecting the resulting sulfonated wood to mechanical defibration.

13 Claims, No Drawings

HIGH YIELD CHEMIMECHANICAL PULPING PROCESSES

BACKGROUND OF THE INVENTION

This invention relates to the production of chemimechanical pulps from wood or other lignocellulosic materials, such as chips, shavings and sawdust, with ultra high yields and with improved strength properties. More particularly, this invention relates to the production of such pulps by means of a three-stage process involving (1) treatment of the wood with sulfur dioxide, (2) sulfonation of the lignin in the wood, using aqueous sulfite and/or bisulfite solutions, followed by (3) mechanical defibering.

The pulp and paper and related industries use many processes to produce pulp from wood chips and other lignocellulosic materials. These processes can be classified, for purposes of discussion, into four groups, shown below with the representative yields:

Chemical Pulps—up to 60% yield
Semichemical Pulps—60–80% yield
Chemimechanical Pulps—80–95% yield
Mechanical Pulps—at least 90% yield The yield ranges shown are approximate only.

Chemical pulps are prepared by cooking the wood chips (or other lignocellulosic material) at elevated temperatures and pressures with various chemical agents which dissolve the lignin and some carbohydrate material to leave relatively pure cellulose fibers at the 40–45% yield level or cellulose plus some residual lignin at somewhat higher yield levels (45–55 percent).

Mechanical pulps, at the other extreme, use mechanical means such as grindstones to defiber logs or disc refiners to defiber wood chips into pulp. These processes use water for cooling and dilution purposes so that the approximately 5 percent of the wood substance that is water soluble is lost for a net yield of about 95 percent.

Chemical pulps have many advantages due to their cleanliness, high strength, and ease of bleaching, but they are expensive to produce due to the low yield. Solid and gaseous waste products from the pulping process give rise to many environmental problems.

Mechanical pulps are much cheaper to produce due to their high yield and constitute an efficient use of forest resources. Such processes offer no gaseous pollution and relatively little $BOD_5$ (biochemical oxygen demand, five-day test) discharge compared to chemical pulps.

The semichemical and chemimechanical pulping processes fall midway between the chemical and mechanical processes in these respects.

The increasing world-wide demands for pulp, paper and other forest products and the decreasing availability of fiber are creating an increasing need for the use of higher yield pulps. The present invention produces a high yield pulp that can replace some types of chemical or semichemical pulp in many products.

It is known that the treatment of wood chips with relatively small amounts of sulfite and bisulfite,at near neutral pH, and under relatively mild cooking conditions (100° C.–150° C., for 2–15 minutes) produces a softening effect on the chips which makes them easier to defiber and generally produces a cleaner and better draining pulp than can be produced by mechanical means alone. See "Ultrahigh Yield NSCM Pulping," by C. A. Richardson, Tappi, Vol. 45, No. 12, pp. 139A–142A (1962); Richardson et al., "Supergroundwood from Aspen," Tappi, Vol. 48, No. 6, pp. 344–346 (1965); Chidester et al., "Chemimechanical Pulps from Various Softwoods and Hardwoods," Tappi, Vol. 43, No. 10, pp. 876–880 (1960); Uschmann U.S. Pat. No. 3,607,618; Aitken et al. U.S. Pat. No. 3,013,934; and Asplund et al. U.S. Pat. No. 3,558,428.

However, the pulps produced by such processes, while being superior to conventional mechanical pulps in terms of cleanliness and drainage properties, do not have sufficiently good physical properties to justify their increased cost of production relative to the conventional mechanical pulps.

Better properties can be achieved by cooking under more severe conditions such as increased temperatures in the 160° C.–240° C. range, but the strength improvement is always accompanied by a loss in yield. Instead of yields of over 90 percent, the yields are reduced to about 70–85 percent. See most of the above publications and patents and Richardson U.S. Pat. No. 2,962,412; Zimmerman U.S. Pat. No. 1,821,198; Cederquist U.S. Pat. No. 3,078,208; Asplund et al. U.S. Pat. No. 3,446,699; Von Hamzburg U.S. Pat. No. 2,949,395; Olson U.S. Pat. No. 3,003,909; and Rasch et al. U.S. Pat. No. 2,847,304.

The disadvantages of the foregoing prior art processes were overcome by the process of the copending application for United States Patent of Michael J. Ford et al., Ser. No. 838,837, filed Oct. 3, 1977, commonly assigned, now U.S. Pat No. 4,116,758. The process of that application provides a chemimechanical wood pulping process whereby the wood is first sulfonated to at least about 85 percent of the maximum level of sulfonation, in an aqueous sulfite/bisulfite solution having a pH of between about 6 and 8.5 at a temperature of between about 100° C. to 150° C. for a period of between about 10 and 90 minutes to provide a wood yield of at least about 90 percent by weight, and thereafter subjecting the wood to mechanical defibration. It was discovered in accordance with that process, to the surprise of those skilled in the art, that the higher the degree of sulfonation, the greater were the strength properties of the pulp obtainable, without any substantial loss in pulp yield. The best strength levels achieved in accordance with that process at yields of above 90 percent were obtained with sulfite cooking liquors having a concentration of about 120 grams per liter of sodium sulfite. However, concentrations of sodium sulfite in the order of at least about 80, and desirably at least about 90, grams per liter also provided advantageous results in accordance with that process.

It has now been discovered in accordance with the process of the present invention that high strength pulps can still be obtained in yields in excess of about 90 percent without requiring the high degree of sulfonation of the process of said Ford et al. application, or the use of such strong solutions of sodium sulfite/sodium bisulfite. These are important aspects of the present invention, since they permit the use of lesser amounts of chemicals in lower concentrations, which thereby reduces the effluent chemical materials which must be treated to avoid environmental problems. What is more, there is also a concomitant saving in chemical costs.

The process of the present invention employs as an important first step the treatment of the wood or other lignocellulosic material with sulfur dioxide gas or an aqueous solution of sulfur dioxide. Thereafter, the sulfur dioxide treated wood is subjected in a second step to a sulfonation treatment with a solution of sodium sulfite/-sodium bisulfite, and finally, in a third step, to mechanical defibration.

The present inventors do not purport to be the first to employ an initial treatment of wood with sulfur dioxide gas or its aqueous solution to be followed by sulfonation with sodium sulfite solution followed by mechanical defibration. Marshall U.S. Pat. No. 3,393,122 discloses such a process. The process of that patent, however, has an entirely different goal, namely, improving the brightness of wood pulp, and is different from the present process. Pulp brightness is not a problem encountered in the process of the present invention. The process of the Marshall patent employs substantially lesser amounts of sulfur dioxide in the initial treatment of the wood. The highest amount of sulfur dioxide employed according to the Marshall patent is no more than 0.5 weight percent based on dry wood and in all other disclosures, including the examples, much lower amounts of sulfur dioxide, such as in the order of 0.005 percent to about 0.2 percent by weight of wood, are employed. Marshall thereafter stores the wood before subjecting it to presteaming treatment at atmospheric pressure, followed by a sulfonation treatment in a sodium sulfite solution, without disclosing the strength of the solution, to be followed by mechanical defibration. As will appear below, the conditions of the present process are quite different from those of the Marshall patent. Steaming the wood chips prior to cooking will drive off the sulfur dioxide. As found in accordance with the present invention, retention of the sulfur dioxide in the wood until sulfonation in sodium sulfite solution is important.

A publication by Kleinert et al., *Tappi,* Vol. 47, No. 10, pp. 605–609 (October 1964) entitled "Thermal coalescense of the Lignin Phase in Wood," discloses the treatment of wood with sulfur dioxide gas, usually in the amounts of about 0.1 percent based on wood as a pretreatment to be followed by conventional solely chemical cooking treatments. The only cooking treatments disclosed are the conventional solely chemical acid sulfite and kraft cooking treatments providing the traditional low pulp yields in the order of only between about 30 and 50 percent.

It is well known that the physical properties of wood pulps are strongly influenced by the flexibility of the individual fibers—which flexibility permits the fibers to be brought into closer contact with each other during the pressing stages of the paper-making process. This, in turn, leads to better bonding and improved strength. Natural wood fibers are rendered relatively inflexible by the presence of large amounts (20–30 percent by weight) of lignin which is a relatively rigid material at moderate temperatures (less than 100° C.) Fiber flexibility is improved in conventional chemical or semichemical pulping processes by removing, chemically, at least part, and in some cases, nearly all of the lignin.

The present invention modifies the lignin sufficiently to produce a marked change in its physical and chemical properties, but not enough to render it soluble in water or in the cooking liquor; it is, therefore, not substantially removed from the wood fiber, and yields are consistent with those of purely mechanical pulps (90–95 percent).

It is, accordingly, an object of the present invention to provide a high yield chemimechanical pulping process for producing pulp from wood chips and other lignocellulosic materials, including shavings and sawdust.

It is another object of the invention to provide a three-step process for producing high yield chemimechanical pulp from wood chips whereby the chips are treated with sulfur dioxide gas or its aqueous solution for a short time followed by pulping in a solution of sodium sulfite/sodium bisulfite and thereafter defibering the chips by customary mechanical means to provide a pulp having excellent strength characteristics.

Other objects will be apparent to those skilled in the art from the present description.

General Description of the Invention

The process of the invention is an improved three-stage process for producing high yield chemimechanical pulps from wood or other lignocellulosic materials, such as wood chips, whereby in the first stage, the wood or other lignocellulosic material is subjected to treatment with sulfur dioxide gas or an aqueous solution of sulfur dioxide, whereby sufficient sulfur dioxide is present to provide an amount of at least about 1 percent by weight, based on weight of wood or other lignocellulosic material; in the second stage, the sulfur dioxide treated wood or lignocellulosic material is sulfonated in an aqueous solution of sodium sulfite/sodium bisulfite containing sufficient sodium hydroxide to neutralize the sulfur dioxide retained in the wood and maintain a pH of the residual liquor at the end of the cook of between about 6 and 8.5, the cooking being at a temperature of between about 100° C. and 150° C. for between about 10 and 90 minutes, without reducing the pulp yield to below about 90 percent; and in the third stage, subjecting the resulting sulfonated wood or other lignocellulosic material to mechanical defibration.

In the process of the invention, the amount of sulfur dioxide gas or solution brought into contact with the wood, such as wood chips, in the initial stage, is at least about 1 percent by weight based on weight of wood up to about 10 percent by weight. Preferably, the amount of sulfur dioxide is between about 2 and 6 percent, although excellent results are obtained at a sulfur dioxide quantity of 2 percent by weight of wood if the sulfonation liquor employed in the second stage shall contain about 3 to 4 percent by weight of sodium sulfite.

The sulfur dioxide may be employed in a mixture with other inert gases so as to constitute at least about 20 percent by volume of sulfur dioxide. Below concentrations of 10 percent by volume, the partial pressure of sulfur dioxide may be insufficient to provide a pickup by the wood of at least 1 percent by weight. Consequently, it may be more desirable to use more concentrated sources of sulfur dioxide gas, such as at least about 20 percent by volume of sulfur dioxide, such as preferably about 20 to 100 percent, more preferably, 20 to 60 percent.

The temperature during the treatment of the wood or other lignocellulosic material with sulfur dioxide in the initial stage is not critical. It may vary from temperatures well below ambient to temperatures well above ambient temperatures. The wood chips can be treated with sulfur dioxide gas even when frozen without any ill effects. No advantage has been observed by employing higher temperatures of treatment with sulfur dioxide gas. Ambient temperatures provide the advantage that no additional energy input is required.

The time of exposure of the wood or other lignocellulosic material to the sulfur dioxide gas may be as short as 5 minutes to times as long as 4 hours, preferably 15 minutes to 1 hour. Treatments of the wood with sulfur dioxide for periods of 8 hours or more may result in some loss in the pulp yield. The time of exposure of the wood to the sulfur dioxide containing gas or solution will depend somewhat upon the size of the particles of wood. For ¾-inch long chips, the foregoing values have been found highly suitable. For shorter chips, a shorter time period may be more suitable and for longer chips, it may be desirable to employ a longer time of exposure to the sulfur dioxide. In essence, the minimum time of sulfur dioxide exposure is that which is required to permit the sulfur dioxide to diffuse to the center of the particles or chips of wood or throughout the lignocellulosic material. The progress of the sulfur dioxide in diffusing to the center of the chips or particles can be determined by previously exposing the chips to iodine so that they adopt the brownish-purple iodine color and then observing the time necessary while exposed to the sulfur dioxide gas for the iodine color to disappear from the center of the chips or particles.

It has been observed that the greater the moisture content of the wood chips, the greater absorption of the sulfur dioxide. Wood chips normally contain about 50 percent moisture when utilized in the paper industry and it is observed that for a range of 40 to 60 percent moisture content, little variation is observed in the degree of absorption of the sulfur dioxide.

When an aqueous solution of sulfur dioxide (sulfurous acid) is employed, it is found to be another satisfactory way of applying sulfur dioxide gas to the wood chips. It has been found desirable to employ an aqueous solution containing at least about 1 percent by weight of sulfur dioxide, based on solution.

It has been found important in the process of the invention to retain the sulfur dioxide content in the chips until they are subjected to the second stage of the process which involves cooking in an aqueous solution of sodium sulfite/sodium bisulfite. It has been discovered that sulfur dioxide is rapidly and readily released by the wood chips and if there is any substantial loss of sulfur dioxide content to below the minimum of 1 percent by weight, the full benefits of the present process are not likely to be achieved. Accordingly, it is desirable to immediately subject the chips to the second stage or sodium sulfite cooking following treatment with sulfur dioxide or to retain the chips in an atmosphere of sulfur dioxide during storage until the chips are ready to be treated in accordance with the second stage.

As a preliminary to the second stage, it is desirable to adjust the pH of the cooking liquor by the addition of sodium hydroxide in order to neutralize the sulfur dioxide contained in the chips to form sodium sulfite, so that after the second stage has been completed, the pH of the residual liquor will be in the range of about 6 to 8.5. This will normally require a pH of the liquor to be added to the chips of about 11 to 12. At the end of the cooking the pH is preferably between about 7 and 8, and more desirably, between about 7.2 and 8. As those skilled in the art will recognize, sulfite and bisulfite normally exist at these pH ranges in an equilibrium, with the shift in the equilibrium being dependent on the pH. At a lower pH, the equilibrium tends to shift toward the formation of bisulfite ion, whereas at a higher pH, the shift is toward the sulfite ion. In the pH range between about 6 and 8.5, both ions are normally present.

As has been pointed out hereinabove, one of the advantages of the present invention over the process of said Ford et al. application is that lower concentrations and amounts of sodium sulfite/sodium bisulfite may be employed in the process of the present invention. The concentration of sodium sulfite in the cooking or second stage of the process should be at least about 1 percent by weight of solution. Amounts of up to about 12 percent may be employed, although no particular advantage is achieved in amounts approaching 12 percent by weight. The preferred range of sodium sulfite content is between about 2 to 7 percent with excellent results being achieved in the range of between about 3 and 6 percent by weight. Optimally, between about 3 and 4 percent is employed.

In the second stage or cooking treatment with sodium sulfite/sodium bisulfite, a temperature range of between about 100° C. and 150° C. is desirable; preferably between about 120° C. and 140° C. The time of cooking with the sodium sulfite solution is normally between about 10 and 90 minutes, with the preferred time period being between about 20 and 60 minutes.

As expressed hereinabove, in accordance with the present invention, the loss in weight of the wood in the course of the process shall not exceed about 10 percent to thereby achieve a yield of at least about 90 percent.

Subsequent to the sulfonation of the wood chips, they are subjected to mechanical defibration, as a third stage, by any of the conventional mechanical grinding or refining techniques. These techniques are well known to those skilled in the art of mechanical and chemimechanical pulping. One such suitable treatment is the use of double-disc refiners whereby the sulfonated chips are passed between rotating grooved discs to apply work to the chips and thereby defibrate them. The sulfonated chips may be passed through one or more refiners until the desired freeness is achieved. Freeness is referred to in terms of Canadian Standard Freeness (CSF) as defined by Tappi Standard T227 (m-58 ).

As will be appreciated by those skilled in the art, the sulfur dioxide employed in the first stage of the process is converted to sodium sulfite by neutralization of alkali to provide part of the concentration of sodium sulfite/-bisulfite in the sulfonation or cooking stage. Thus, the sulfur dioxide employed in the first stage can also be utilized in the second stage to form part of the concentration of sodium sulfite/bisulfite.

The process of the present invention is applicable to woods of all types, both hardwood and softwoods, particularly the latter.

An important feature of the present process is the ability to produce high yield pulps with excellent strength properties while employing only low concentrations of sodium sulfite/bisulfite in the cooking liquor. This is illustrated by the examples in Table I, below. It is seen that with a 2 percent sulfur dioxide pretreatment for 15 minutes at ambient temperature, a pulp obtained by sulfonation with 3.3 percent solution of sodium sulfite (Example 1, below), has superior properties to a pulp obtained by sulfonation with 3.3 percent solution of sodium sulfite, without treatment with sulfur dioxide (Example 2, below). In fact, this pulp obtained by sulfur dioxide treatment followed by sulfonation with a solution having a concentration of as little as 3.3 percent sodium sulfite has properties similar to those of a highly sulfonated pulp produced with 12 percent sodium sulfite, as in Example 3.

At the higher level of concentration of sodium sulfite used in the cooking solutions for Examples 4 and 5, below, the benefits of the pretreatment are still evident (as shown in Table II, below), but to a lesser degree. Comparison of Examples 1 and 4 shows that there is no particular advantage in using the higher level of sodium sulfite with chips subjected to first stage treatment with sulfur dioxide. Without treatment with sulfur dioxide, however, higher levels of sodium sulfite are necessary to achieve improved physical properties and to reach the levels obtained with the sulfur dioxide treated chips of Example 1, it is necessary to use as much as 12 percent sodium sulfite, as in Example 3.

The examples in Table III, below, show the effect of sulfur dioxide exposure time on physical properties. It is evident from these data that at the longer pretreatment times there is a decrease in yield and brightness, but the long fiber content and wet web strengths are increased. The other physical properties are not greatly affected by sulfur dioxide treatment times in excess of 15 minutes, as shown by Example 1 . A treatment time of 5 minutes with sulfur dioxide at the particular concentration involved was insufficient to obtain the benefits of a sulfur dioxide pretreatment.

The examples in Table IV, below, show the importance of retaining the sulfur dioxide with the chips until contracted with cooking liquor if maximum benefits are to be obtained. The cooking liquor concentration was maintained at a constant level in Examples 10–12. It is evident from Example 11 that when the chips lose all of the sulfur dioxide before the cooking liquor is applied, the resulting pulp has physical properties which are comparable to those of a pulp cooked at the same sulfite concentration without pretreatment, see Example 12.

The pulps made from this invention are useful in such products as newsprint, coated papers, book papers, sanitary tissues, corrugating medium, linerboard, paper toweling, diaper fluff, milk carton board, etc.

Specific Description of the Invention

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified. Data are presented in Tables I to IV, below.

EXAMPLE 1

A pulp was prepared using a 20-liter digester provided with liquor circulation and a 12" Sprout Waldron disc refiner.

A mixture of northern softwood chips (¾-inch long) containing approximately 42 percent spruce, 35 percent balsam fir, and 23 percent jack pine were exposed in a closed plastic bag to 2 percent sulfur dioxide on weight of wood. The sulfur dioxide gas was introduced into the sealed bag containing the chips over a 5 minute period with agitation of the chips. The quantity added was measured using both a flowmeter and by weight increase of the chips. Following addition of sulfur dioxide gas, the chips were held for 15 minutes and then a portion of the cooking liquor was applied to the chips to effectively wet the wood surface and prevent the escape of sulfur dioxide. The contents of the bag were poured into the 20-liter laboratory digester followed by the remaining sodium sulfite cooking liquor to provide a 5.9:1 liquor/wood ratio. The cooking liquor at ambient temperature contained 2.6 percent $Na_2SO_3$ and 0.47 percent of NaOH, i.e., sufficient NaOH to neutralize the sulfur dioxide introduced with the chips and maintain the preferred final cooking pH of 7.4. The sodium sulfite formed by neutralization of the sulfur dioxide increased the level of sulfite in the cooking liquor by 0.7 percent to 3.3 percent. The temperature in the digester was raised to 140° C., during a period of 5 minutes, and held at this temperature for 30 minutes, during which time sodium sulfite liquor was circulated in the digester to complete the cooking of the chips. The cooked chips were refined in three stages to the desired freeness using the 12" laboratory refiner. Physical properties were measured on handsheets prepared from the pulp after laboratory screening and centricleaning. The properties are shown in Tables I and III, below.

EXAMPLE 2

This is a control or comparison example.

In this example, chips were not pretreated with sulfur dioxide. The concentration of cooking liquor was 3.3 percent sodium sulfite and had a final pH of 7.8. This example provides a control for Example 1, which also had the same final pH and sodium sulfite concentration but in which part of the sulfur dioxide required to form the sodium sulfite was added to the chips in the sodium sulfite cooking treatment stage. The cooking treatment was otherwise the same as in Example 1. The properties of the pulp are shown in Tables I and III, below.

EXAMPLE 3

This is a comparison example.

This example is similar to Example 2, except that the cooking liquor concentration was 12.0 percent sodium sulfite, in accordance with the process of said Ford et al. application, and produced a highly sulfonated pulp with excellent strength properties. The properties of the pulp are shown in Table I below.

EXAMPLE 4

Example 1 was repeated, except that the cooking liquor contained 6.0 percent sodium sulfite. The properties of the pulp are shown in Table II, below.

EXAMPLE 5

This is a comparison example.

This example is similar to Example 2, except that the cooking liquor concentration was 6.7 percent sodium sulfite. This example provides a control for Example 4. The properties of the pulp are shown in Table II, below.

EXAMPLE 6

Example 1 was repeated, except that following the 5 minute period of sulfur dioxide addition, the chips were held for 2 hours before adding cooking liquor. The properties of the pulp are shown in Table III, below.

EXAMPLE 7

Example 1 was repeated, except that following the 5 minute period of sulfur dioxide addition, the chips were held for 8 hours before adding the cooking liquor. The properties of the pulp are shown in Table III, below.

EXAMPLE 8

Example 1 was repeated, except that following the 5 minute period of sulfur dioxide addition, the chips were held for 24 hours before adding the cooking liquor. The properties of the pulp are shown in Table III, below.

EXAMPLE 9

Example 1 was repeated, except that following the 5 minute period of sulfur dioxide addition, the chips were held for 72 hours before adding the cooking liquor. The properties of the pulp are shown in Table III, below.

EXAMPLE 10

Example 1 was repeated, employing a different mixture of wood chips comprising 51 percent spruce, 39 percent balsam fir and 10 percent jack pine. The properties of the pulp are shown in Table IV, below.

EXAMPLE 11

Example 10 was repeated, except that the sulfur dioxide treated chips were exposed to the atmosphere for 60 minutes prior to the addition of cooking liquor. The results are shown in Table IV, below.

EXAMPLE 12

This is a control example.

Example 2 was repeated, except that the chip mixture of Example 10 was employed. The results are shown in Table IV, below.

EXAMPLE 13

Pilot Plant Scale Operation

In this example, pulps were prepared in a nominal 10 ton per day pilot plant to confirm the beneficial effect of the sulfur dioxide initial treatment on a larger scale. In this example, the wood chips were digested in a continuous 3-tube Bauer M&D digester. This type of digester is described in *Paper Trade Journal,* pages 36–37 (September 5, 1960) in an article by Van Derveer, entitled "Unique New Continuous Digesters Improve Operations at Two Mills;" also, *Pulp and Paper International,* May 1971, pages 55–56. The chips pass through the tubes of the continuous digester by means of conveyors.

In this example, the refiner employed on the chips after sulfonation with sodium sulfite in the digester was a double-disc refiner manufactured by Bauer Bros. (now C-E Bauer) known as Model 400. This double-disc refiner employs 36-inch diameter grooved discs and two 110 kilowatt (150 horsepower) motors. Type 36161 plates were used in the first stage, and 36106 or 36104 plates were employed in the second stage of refining. The feed rate through the refiner was between two and four tons per day.

A mixture of northern softwood chips was fed into the M&D digester. The first tube or No. 1 tube of the digester was used strictly for sulfur dioxide addition. Liquid sulfur dioxide from a 2000 lb. cylinder was fed through a rotameter, a micrometer valve, then after expansion from liquid to a gas to the B-quadrant of the No. 1 tube to give 2 percent sulfur dioxide based on weight of wood. The total time in the No. 1 tube was 23 minutes at atmospheric pressure, which allowed the sulfur dioxide to be in contact with the chips for 15 minutes (based on the addition point in the B-quadrant of the No. 1 tube). The temperature varied from 90°–93° C. due to some steam blowback through the rotary valve from the No. 2 tube of the digester. Sufficient sodium hydroxide and sodium sulfite were added in the second tube of the digester to neutralize the sulfur dioxide and provide cooking liquor strength of 6 percent sodium sulfite. Temperature in the second and third tubes of the digester was maintained at 140° C. with the final pH of the system being 7.8. Cooking times in tubes Nos. 2 and 3 of the digester were 20 minutes and 15 minutes, respectively.

A series of control runs with no sulfur dioxide initial treatment were made in which cooking was carried out with 12 percent by weight sodium sulfite liquor in all three tubes of the digester with retention times in each tube of 15, 10, and 10 minutes, respectively.

After refining, all pulp samples were screened, centrifugally cleaned and tested for physical properties. All physical properties were plotted against freeness and the values interpolated at 300 Canadian Standard Freeness to give the properties and results shown below:

Physical Properties of Pulp Obtained in Example 13

| | Physical Properties of Pulp Obtained in Example 13 | |
|---|---|---|
| Properties at 300 CSF | Sulfonation With 12% Sodium Sulfite Solution Without Initial Sulfur Dioxide Treatment | Initial Treatment With 2% Sulfur Dioxide Followed By Sulfonation With 6% Sodium Sulfite Solution |
| Tear Factor | 89 | 91 |
| Burst Factor | 35 | 34 |
| Breaking Length (Meters) | 6300 | 6200 |
| Wet Web Strength | 44 | 44 |
| Apparent Specific Volume | 2.03 | 2.04 |

TABLE I

| | 2% $SO_2$ Pretreated | No $SO_2$ Pretreatment | |
|---|---|---|---|
| Example No. | 1 | 2 | 3 |
| Cooking Liquor Concentration ≡% $Na_2SO_3$ Fresh Liquor 30 min. at 140° C. | 3.3 | 3.3 | 12.0 |
| Brightness | 54.8 | 55.9 | 57.0 |
| Yield, % | 93.7 | 92.6 | 93.1 |
| % Total Sulfur in Pulp | 0.41 | 0.35 | 0.60 |
| Physical Properties at 350 CSF | | | |
| Burst Factor | 23 | 17 | 24 |
| Tear Factor | 93 | 85 | 81 |
| Breaking Length (Meters) | 5200 | 4200 | 5300 |
| Apparent Specific Volume | 2.45 | 2.51 | 2.28 |
| % Long Fiber (>48 mesh) | 69.4 | 64.2 | 66.0 |
| Wet Web Strength | 25.6 | 23.0 | 23.0 |

TABLE II

| | 2% $SO_2$ Pretreated | No $SO_2$ Pretreatment |
|---|---|---|
| Example No. | 4 | 5 |
| Cooking Liquor Concentration ≡% $Na_2SO_3$ Fresh Liquor 30 min. at 140° C. | 6.7 | 6.7 |
| Brightness | 56.2 | 56.3 |
| Yield, % | 93.2 | 92.3 |
| % Total Sulfur in Pulp | 0.54 | 0.48 |
| Physical Properties at 350 CSF | | |
| Burst Factor | 25 | 19 |
| Tear Factor | 87 | 85 |
| Breaking Length (Meters) | 5200 | 4600 |
| Apparent Specific Volume | 2.37 | 2.39 |
| % Long Fiber (>48 mesh) | 66.5 | 62.4 |

TABLE II-continued

| | 2% $SO_2$ Pretreated | No $SO_2$ Pretreatment |
|---|---|---|
| Example No. | 4 | 5 |
| Wet Web Strength | 27 | 24.7 |

TABLE III

| | Effect of Time in $SO_2$ Exposure | | | | | |
|---|---|---|---|---|---|---|
| Example No. | 1 | 2 | 6 | 7 | 8 | 9 |
| $SO_2$ Treatment Time (20° C.) | 15 min. | Control No $SO_2$ Pre-Treatment | 2 hours | 8 hours | 24 hours | 72 hours |
| Cooking Liquor ≡% $Na_2SO_3$ | | | 3.3% | | | |
| Brightness | 54.8 | 55.9 | 53.7 | 53.7 | 51.4 | 50.8 |
| Yield, % | 94 | 93 | 93 | 90 | 90 | 87 |
| % Total Sulfur in Pulp | 0.41 | 0.35 | 0.40 | 0.45 | 0.41 | — |
| Physical Properties at 350 CSF | | | | | | |
| Burst Factor | 23 | 17 | 26 | 22 | 26 | 26 |
| Tear Factor | 93 | 85 | 93 | 93 | 97 | 99 |
| Breaking Length (Meters) | 5200 | 4200 | 5300 | 5000 | 5300 | 5300 |
| Apparent Specific Volume | 2.45 | 2.51 | 2.25 | 2.38 | 2.31 | 2.33 |
| % Long Fiber (>48 mesh) | 69.4 | 64.2 | 71.2 | 71.0 | 73.5 | 73.5 |
| Wet Web Strength | 25.6 | 23.0 | 30.0 | 30.0 | 37.0 | 37.0 |

TABLE IV

| Example No. | 10 | 11 | 12 |
|---|---|---|---|
| $SO_2$ Treatment | 2% on O.D. wood for 15 min. | | No $SO_2$ Pre-Treatment |
| | $SO_2$ Retained | 60 min. Aeration in open atmosphere before cooking | |
| Cooking Liquor ≡ $Na_2SO_3$ at pH 7.8, 30 min. at 140° C. | | 3.3 | |
| Brightness | 52.0 | 52.8 | 52.8 |
| Yield, % | 92.0 | 96.7 | 93.8 |
| % Total Sulfur | 0.45 | 0.44 | 0.36 |
| Physical Properties at 350 CSF | | | |
| Burst Factor | 19.8 | 17.5 | 15.7 |
| Tear Factor | 97 | 87 | 100 |
| Breaking Length (Meters) | 4750 | 3900 | 4100 |
| Apparent Specific Volume | 2.61 | 2.61 | 2.61 |
| % Long Fiber (>48 mesh) | 63.0 | 58.0 | 59.5 |
| Wet Web Strength | 27.0 | 24.5 | 21.5 |

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claims.

What is claimed is:

1. A high yield chemimechanical pulping process for producing pulp from woody lignocellulosic material, which process comprises treating said woody lignocellulosic material with sulfur dioxide in an amount of at least about 1 percent by weight based on weight of said woody lignocellulosic material, sulfonating the resulting woody lignocellulosic material for a time sufficient to allow the suffur dioxide to diffuse throughout the lignocellulosic material while still containing at least 1 percent by weight of sulfur dioxide in aqueous solution of a mixture of sulfite and bisulfite wherein the amount of sulfite and bisulfite in said aqueous solution is between 2 and 7 percent by weight calculated as sodium sulfite at a temperature of between about 100° C. and 150° C. for a period of between about 10 and 90 minutes, said aqueous solution having a pH of between about 6 and 8.5 at end of said sulfonating, without reducing the yield of pulp below about 90 percent by weight, and subsequently subjecting the resulting sulfonated woody lignocellulosic material to mechanical defibration.

2. A high yield chemimechanical process according to claim 1, wherein the amount of sulfur dioxide employed is between about 1 percent and 10 percent by weight of wood.

3. A high yield chemimechanical process according to claim 1, wherein the amount of sulfur dioxide employed is between about 2 percent and 6 percent by weight of wood.

4. A high yield chemimechanical process according to claim 1, wherein the sulfur dioxide is contained in a mixture of gases comprising at least about 20 percent by volume of sulfur dioxide.

5. A high yield chemimechanical process according to claim 1, wherein the woody lignocellulosic material is subjected to treatment with sulfur dioxide gas for between about 5 minutes and 4 hours.

6. A high yield chemimechanical process according to claim 1, wherein the aqueous solution of a mixture of sulfite and bisulfite is of sodium sulfite and sodium bisulfite.

7. A high yield chemimechanical process according to claim 1, wherein said pH is between about 7 and 8.

8. A high yield chemimechanical process according to claim 1, wherein said pH is between about 7.2 and 8.0.

9. A high yield chemimechanical process according to claim 1, wherein said temperature is between about 120° C. and 140° C.

10. A high yield chemimechanical process according to claim 1, wherein said period of treatment with said aqueous solution is between about 20 to 60 minutes.

11. A high yield chemimechanical process according to claim 1, wherein the woody lignocellulosic material is wood chips.

12. A high yield chemimechanical process according to claim 1, wherein the woody lignocellulosic material is sawdust.

13. A high yield chemimechanical process according to claim 1, wherein said woody lignocellulosic material is subjected to said treatment in said aqueous solution of sulfite and bisulfite immediately after said treatment with said sulfur dioxide.

* * * * *